United States Patent [19]

Beck et al.

[11] Patent Number: 4,865,701

[45] Date of Patent: Sep. 12, 1989

[54] ELECTROLYTIC REDUCTION OF ALUMINA

[76] Inventors: Theodore R. Beck, 10035 31st Ave. N.E., Seattle, Wash. 98125; Richard J. Brooks, 3802 East McGilvra Pl., Seattle, Wash. 98112

[21] Appl. No.: 238,472

[22] Filed: Aug. 31, 1988

[51] Int. Cl.[4] ..... C25C 3/06; C25C 3/08; C25C 3/12

[52] U.S. Cl. ..... 204/67; 204/241; 204/244; 204/245; 204/247

[58] Field of Search ..... 204/67, 243 R–247, 204/241

[56] References Cited

U.S. PATENT DOCUMENTS

| | | | |
|---|---|---|---|
| 3,562,136 | 2/1971 | De Varda et al. | 204/244 X |
| 3,647,673 | 3/1972 | De Varda et al. | 204/244 |
| 3,730,859 | 5/1973 | De Varda | 204/244 X |
| 3,930,967 | 1/1976 | Alder | 204/244 X |
| 4,592,812 | 6/1986 | Beck et al. | 204/67 |
| 4,681,671 | 7/1987 | Duruz | 204/67 |

*Primary Examiner*—Donald R. Valentine

[57] ABSTRACT

Alumina is reduced to molten aluminum in an electrolytic cell containing a molten electrolyte bath composed of halide salts and having a density less than alumina and aluminum and a melting point less than aluminum. The cell comprises a plurality of vertically disposed, spaced-apart, non-consumable, dimensionally stable anodes and cathodes. Alumina particles are dispersed in the bath to form a slurry. Current is passed between the electrodes, and oxygen bubbles form at the anodes, and molten aluminum droplets form at the cathodes. The oxygen bubbles agitate the bath and enhance dissolution of the alumina adjacent the anodes and inhibit the alumina particles from settling at the bottom of the bath. The molten aluminum droplets flow downwardly along the cathodes and accumulate at the bottom of the bath.

37 Claims, 1 Drawing Sheet

ELECTROLYTIC REDUCTION OF ALUMINA

BACKGROUND OF THE INVENTION

The present invention relates generally to the production of metallic aluminum from alumina ($Al_2O_3$) and more particularly to a method and apparatus for electrolytically reducing alumina to aluminum.

For many decades, the principle commercial method employed for the electrolytic reduction of alumina to aluminum has been the Hall-Heroult process. This process employs a cell comprising a vessel or pot containing a molten electrolyte bath comprising sodium cryolite ($Na_3AlF_6$) as the principal constituent. The interior of the vessel is lined with carbon. A pool of molten aluminum lies on the bottom of the vessel and forms the cathode for the cell, and consumable carbon anodes located above the electrolyte bath extend downwardly through the top of the electrolyte bath. Alumina is introduced into the molten electrolyte bath wherein the alumina dissolves and a number of reactions occur, eventually producing molten aluminum which accumulates at the bottom of the vessel and carbon dioxide, and some carbon monoxide from a side reaction, which are given off from the top of the cell.

There are a number of drawbacks and disadvantages to the Hall-Heroult process, and these are discussed in some detail in Beck, et al., U.S. Pat. No. 4,592,812, the disclosure of which is incorporated herein by reference. One of the drawbacks of the Hall-Heroult process is that it employs consumable carbon anodes which must be periodically vertically adjusted during the electrolytic reduction operation and which also must be frequently replaced when the anode has been consumed down to a butt.

Attempts have been made to develop non-consumable anodes for use in the Hall-Heroult process to replace consumable carbon anodes. The non-consumable anodes are typically composed of a nickel-iron-copper cermet (a mixture of oxide and metallic particles). Examples of this and other materials developed for use in non-consumable anodes are described in the following U.S. Pat. Nos.: Ray 4,374,050, Ray 4,399,008, Ray et al. 4,454,015 and Ray et al. 4,455,211; and the disclosures of these patents are incorporated herein by reference.

Non-consumable anodes of the type described above have been employed in conjunction with a cryolite electrolytic bath, similar to that employed in the Hall-Heroult process, having a conventional operating temperature of about 950° C. (1742° F.). Three basic problems have been encountered with these non-consumable anodes: corrosion of the anodes in the bath, bath penetration into the anodes and fracture of the anodes. These problems must be overcome before the non-consumable anodes can be employed in commercial aluminum reduction cells. Attempts have been made to overcome these problems by improving the properties of the non-consumable anode materials, but even with the improved properties thus far obtained, the anodes still fall short of the goal for operation at the conventional Hall-Heroult process temperature of 950° C. (1742° F.).

The above-noted Beck, et al., U.S. Pat. No. 4,592,812 discloses an alumina electrolytic reduction cell employing non-consumable cermet anodes operating in a preferred temperature range of 700°-800° C. (1292°-1472° F.). In this cell, the anode is located at the bottom of the cell, and the cathode is horizontally disposed above the anode. The electrolytic reaction in this cell generates oxygen at the anode rather than carbon dioxide as in the Hall-Heroult cell. The alumina tends to sink toward the bottom of the cell, because its density is greater than the density of the electrolytic bath, but the alumina is maintained in suspension within the bath adjacent the bottom of the cell by the rising oxygen bubbles generated at the anode. The alumina saturates the bath next to the bottom and retards the corrosion rate of the anode located there.

The density of the bath is greater than that of the aluminum and molten aluminum formed at the cathodes rises to the top of the bath. The cathodes are non-consumable and are composed of titanium diboride which is wet by aluminum which thus follows the surface of the cathode as it rises to the top of the bath. Refractory barriers at the top of the cell provide channels for the oxygen to escape the bath without contacting the aluminum pool accumulating at the top of the bath.

The electrolytic reduction cell described in the Beck, et al. patent eliminates many of the drawbacks and disadvantages of the Hall-Heroult cell, and this is discussed in detail in the Beck, et al. patent. Nevertheless, there are drawbacks to this arrangement and these include the need to employ a horizontal anode located on the bottom of the cell and horizontal cathodes.

SUMMARY OF THE INVENTION

Many of the disadvantages and drawbacks of the prior art methods and apparatuses for the electrolytic reduction of alumina have been eliminated by an apparatus and method in accordance with the present invention which is essentially an improvement upon Beck, et al., U.S. Pat. No. 4,592,812.

The cell of the present invention comprises a molten electrolyte bath composed of halide salts having a density less than that of molten aluminum (2.3 g/cm$^3$) and of alumina (4.0 g/cm$^3$). For reasons to be subsequently explained, the cell is operable at a lower temperature than the Hall-Heroult process, and the bath therefore has a melting point lower than that of the sodium cryolite bath employed in the Hall-Heroult process. Bath mixtures of sodium, lithium, and aluminum fluorides and chlorides having the desired lower melting point are well known.

A plurality of dimensionally stable, non-consumable anodes and cathodes are disposed vertically in the cell and extend downwardly through the top surface of the bath. The anodes and cathodes are spaced apart in close, alternating arrangement. The anodes may be made of an electrically conducting, chemically resistant cermet, and the cathodes may be composed of graphite or of an electrically conducting, chemically resistant, refractory hard metal wet by molten aluminum, such as titanium diboride ($TiB_2$).

Alumina particles devoid of carbonaceous material are introduced into the cell, and an electric current is passed through the bath from the anodes to the cathodes. Ions of aluminum and oxygen ($Al^{3+}$ and $O^{=}$) are formed from the alumina in the bath. (Actually, these ions are complexed with each other and with fluoride ions ($F^-$), but the simple case described in the preceding sentence suffices for the present discussion.) The oxygen ions are converted into gaseous oxygen at the anodes, and the aluminum ions are converted into metallic aluminum at the cathodes.

The gaseous oxygen formed at an anode bubbles upwardly therefrom, through the bath, agitates the bath and fluidizes or maintains in suspension the alumina particles in the bath adjacent the anode. This enhances the dissolution of alumina in that part of the bath adjacent the anode, to obtain and maintain there a substantial concentration of dissolved alumina.

A fine particle size alumina (e.g., minus 325 mesh or 50 micrometers) is used to avoid or minimize settling out of alumina on the bottom of the cell, which would be undesirable because it would interfere with bath circulation and general operation of the cell.

The present invention thus enables one to maintain an appropriate concentration of dissolved alumina adjacent the anode while also maintaining undissolved alumina particles in suspension adjacent the anode where these particles are needed to provide a ready supply of undissolved alumina for further dissolution there. Maintaining an appropriate concentration of dissolved alumina near the anode, with expedients other than a high bath temperature, is desirable because it allows a lower bath temperature which increases current efficiency and decreases corrosion of the anodes and of the cell's lining.

There is thus provided within the cell a slurry composed of finely divided alumina particles dispersed in a molten electrolyte bath composed of halide salts having a density less than that of alumina and of aluminum.

The metallic aluminum formed at the cathodes flows downwardly, along cathode surfaces formed of refractory hard metal wet by aluminum, to the bottom of the cell where the molten aluminum accumulates for periodic removal from the cell by siphoning or other conventional methods.

Because the electrodes are non-consumable, they need not be vertically adjustable, and they may therefore be immovably mounted in the cell. In such a case the side walls and bottom of the cell are provided with cooling structure for temperature control.

Other features and advantages are inherent in the method and apparatus claimed and disclosed or will become apparent to those skilled in the art from the following detailed description in conjunction with the accompanying diagrammatic drawings.

DETAILED DESCRIPTION

Figure 1:
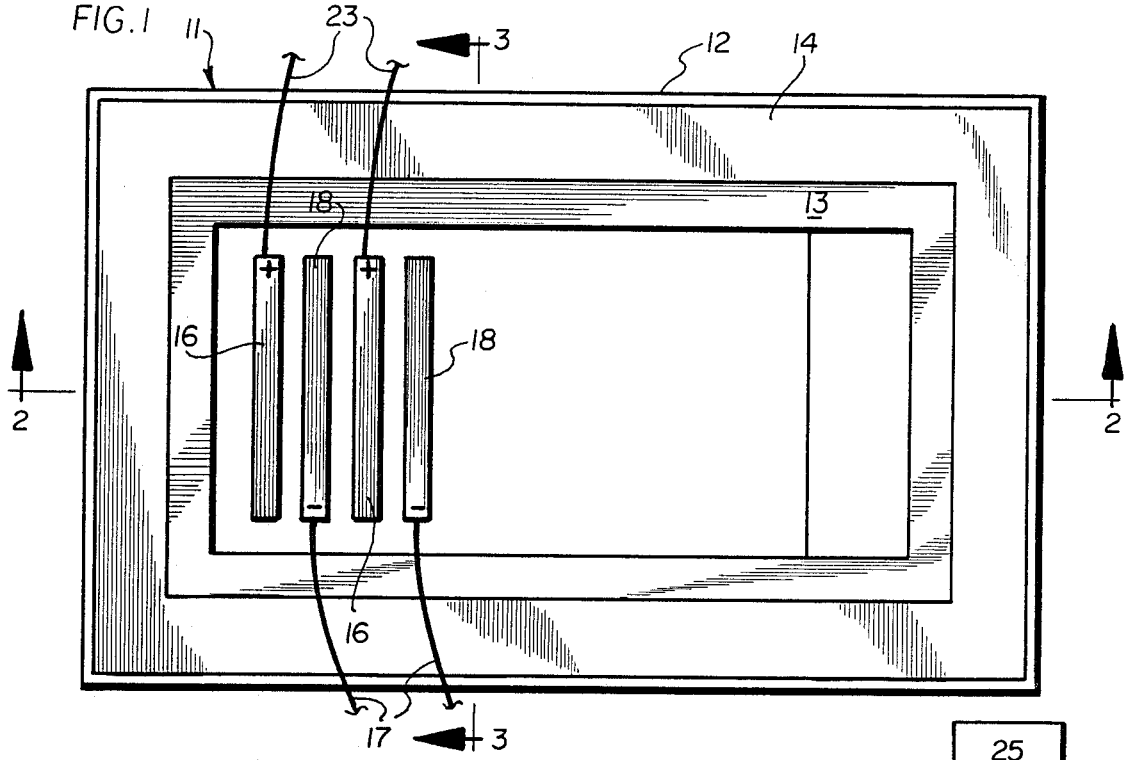
FIG. 1 is a plan view illustrating an embodiment of an electrolytic reduction cell in accordance with the present invention.
Figure 2:
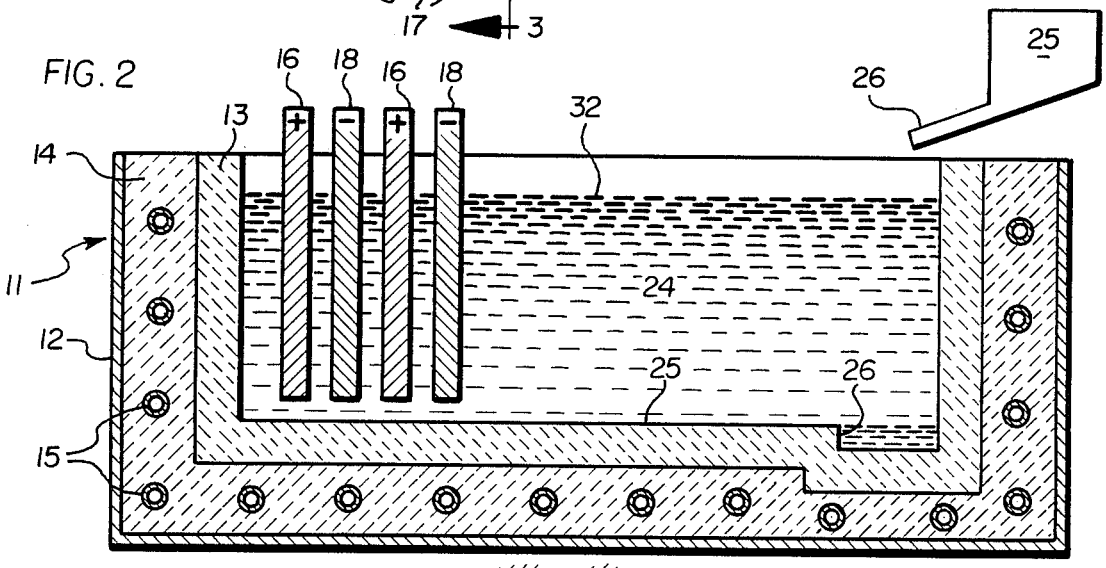
FIG. 2 is a sectional view taken along line 2—2 of FIG. 1.
Figure 3:
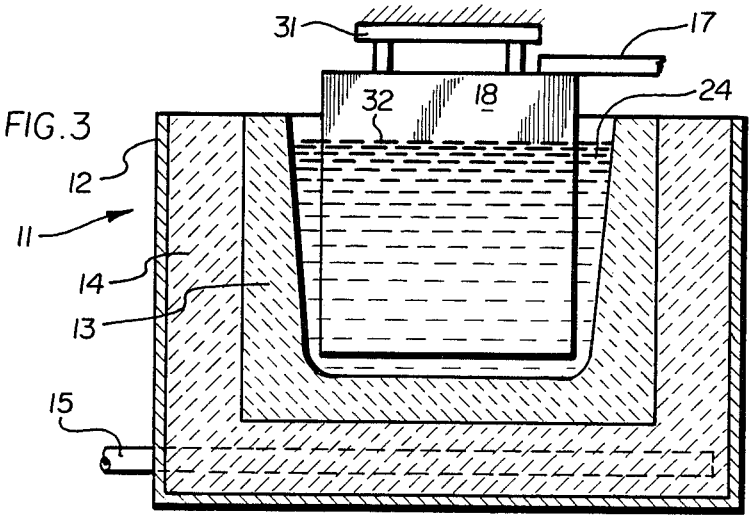
FIG. 3 is a sectional view taken along line 3—3 of FIG. 1.

Referring to FIGS. 1–3, indicated generally at 11 is a cell for the electrolytic reduction of alumina to aluminum, constructed in accordance with an embodiment of the present invention. Cell 11 comprises a steel shell 12 having a bottom and side walls lined with a layer of thermal insulating material 14 within which are cooling pipes 15. The interior of cell 11 has walls lined with electrically-insulating, refractory material 13. Contained within cell 11 is a molten electrolyte bath 24 composed of halide salts having a melting point less than that of aluminum (659° C. or 1218° F.) and having a density less than that of aluminum (2.3 g/cm$^3$) and less than that of alumina (4.0 g/cm$^3$).

The bath may be composed of sodium, lithium, and aluminum fluorides or chlorides or mixed fluorides and chlorides to obtain the proper overall properties of melting point, density, viscosity, and alumina solubility. Examples of bath compositions in accordance with the present invention include the following ingredients in wt. %:

| Ingredient | Bath A | Bath B |
|---|---|---|
| $Na_3AlF_6$ | 38 | 24 |
| $AlF_3$ | 41 | 52 |
| LiF | 21 | 24 |

Other baths in accordance with the present invention may contain, in combination, (a) up to 50 wt. % $AlF_3$, (b) any combination of $Na_3AlF_6$ and LiF plus (c) NaCl. The principal criteria for the bath (in addition to density), are that the melting point, viscosity and solubility therein of alumina, under the conditions prevailing in a cell operated in accordance with the present invention, permit a cell operating temperature well below that of the Hall-Heroult process (950° C. or 1742° F.), e.g., below 850° C. (1562° F.) and preferably below 750° C. (1382° F.).

The electrically-insulating, refractory material at 13 may be any material that is resistant to dissolution by the bath and the aluminum metal contained therein. Example materials are fused alumina, silicon oxynitride, magnesia and silicon carbide. The thermal insulating material at 14 is typically loose alumina powder but may be other suitable material.

Bath 24 has a top surface 32 through which extend anodes 16 and cathodes 18 both of which are non-consumable and dimensionally-stable. Anode leads or bus members 23 and cathode leads 17 connect to adjacent cells (not shown).

The anode is preferably a Ni—Fe—Cu cermet comprising a Ni—Fe—Cu alloy interwoven in a mixture of nickel iron oxide ($Ni_xFe_{1-x}O$) and nickel ferrite oxide ($Ni_yFe_{3-y}O_4$). Other cermets include nickel interwoven in nickel ferrite oxide and Cu—NiO—$Fe_2O_9$. These and/or other cermets or anode compositions are described in the disclosures of the Ray and Ray et al. U.S. patents identified above and incorporated herein by reference. The criteria for the anode material are that the material have substantial resistance, in the bath, to corrosion, bath penetration and fracture, under the operating conditions and bath compositions employed in accordance with the present invention.

The cathode is typically composed of an electrically conductive, refractory hard metal which is wet by molten aluminum and stands up well in the bath under the operating conditions of the present invention. The preferred cathode materials is titanium diboride ($TiB_2$). Other useful cathode materials include titanium carbide (TiC), zirconium carbide (ZrC) and zirconium diboride ($ZrB_2$), niobium diboride ($NbB_2$), tantalum diboride ($TaB_2$) and combinations of said diboride in solid solution form (e.g., $(Nb,Ta)B_2$). Graphite may also be used.

The cathode may be in the form of a graphite core having an outer surface layer composed of the refractory hard metal (e.g., as tiles adhered to the graphite core). Another embodiment of cathode has an outer layer of a composite paste containing refractory hard metal (e.g., $TiB_2$) and graphite plus coal tar pitch as a binder.

Alumina particles may be added to the bath, through the top of the bath, in any convenient location and manner, e.g., from a hopper 25 through a conduit 26

(FIG. 2). The alumina is composed of finely divided particles (e.g., floury alumina) having a size less than 100 micrometers. Preferably at least a major portion of the particles are less than 50 micrometers (minus 325 mesh). The smaller the alumina particles, the less the tendency to settle out on the bottom of the cell. The alumina particles are devoid of carbon, and no carbon reducing agent is employed in the method.

An electric current is passed through bath 24 from each anode 16 to each cathode 18. The alumina introduced into bath 24 is dissolved therein and formed into ions of aluminum and oxygen ($Al^{3+}$ and $O^{=}$). In the course of a series of reactions, the aluminum ions are converted into metallic aluminum at each cathode 18, and the oxygen ions are converted into gaseous oxygen at each anode 16.

The layer of titanium diboride or other refractory hard metal at the surface of each cathode 18 is wet by the aluminum which flows downwardly along the titanium diboride cathode surface to the cell bottom 25 which is sloped toward a sump 26 into which the molten aluminum drains. There is no electric current flow through the molten aluminum at the bottom of the cell, and there is no electric current flow though cell lining 13.

The gaseous oxygen which forms at each anode 16 bubbles upwardly through bath 24 to agitate the bath adjacent each anode. This agitation enhances the dissolution of the alumina in the electrolyte bath and maintains a substantial saturation of dissolved alumina in that part of the bath adjacent each anode 16, which is desirable. The agitation caused by the upwardly bubbling gaseous oxygen from each anode, also maintains the undissolved alumina particles in suspension throughout the bath and substantially inhibits alumina particles within the bath from settling in a layer at cell bottom 25. There is no expedient or provision for maintaining the alumina particles on the bottom of the cell or allowing them to accumulate there, an occurrence which would be undesirable in the method of the present invention. As a result, the slurry is maintained substantially uniformly throughout the cell.

There is no substantial mixing between the rising oxygen bubbles and the descending molten aluminum because the latter wets the cathode surface and follows that surface closely during its descent, thus maintaining the descending molten aluminum separate and apart from the rising oxygen bubbles.

Oxygen bubbling upwardly through top surface 32 of bath 24 may be accumulated within an exhaust hood (not shown) communicating with an exhaust conduit (not shown).

A cell in accordance with the present invention may operate at a temperature in the range of about 665–850° C. (1229°–1562° F.). 665° C. is slightly above the melting point of aluminum (659° C.), and 850° C. is substantially below the operating temperature of the Hall-Heroult process (950° C.). 690°–750° C. (1274°–1382° F.) is the preferred operating range. 700° C. (1292° F.) is a desirable operating temperature.

In comparison to the Hall-Heroult operating temperature of 950° C., the cooler operating temperatures of the present invention increase current efficiency and reduce corrosion of the refractory hard metal surface on the cathode, corrosion of the anode, and corrosion of the refractory material which lines the interior of the cell. The temperature within the bath is controlled by cooling pipes 15.

Because it is essential that the molten aluminum sink through the slurry composed of bath 24 with alumina particles dispersed therein, it is important that not only bath 24 but also the slurry have a density less than that of molten aluminum (2.3 g/cm$^3$). Bath 24, without alumina particles dispersed therein, would have a density in the range 1.8–2.0 g/cm$^3$. The alumina density is about 4.0 g/cm$^3$. Accordingly, the amount of alumina added must be controlled so that the density of the resulting slurry does not exceed that of the bath by more than about 0.2 g/cm$^3$, for example, to produce a slurry density typically in the range 2.0–2.2 g/cm$^3$.

A cell in accordance with the present invention will operate at a current density comparable to that of the Hall-Heroult cell, e.g., ampere/cm$^2$. Aluminum production from a given cell is proportional to the current density.

As noted above, lowering the bath temperature increases anode life which is limited by corrosion, by bath penetration into the anode and by fracture, all of which are adversely affected by increased bath temperature. For nickel-iron cermet anodes, the smallest corrosion rate obtainable at 950° C. is about 2 cm/yr, and these materials were marginal with respect to avoiding contamination of the nickel and iron by aluminum produced during operation of the cell. Decreasing the bath temperature from 950° C. (1742° F.), the Hall-Heroult operating temperature, to 700° C. (1292° F.) (the method of the present invention) should reduce iron corrosion by about thirty fold and nickel corrosion by about one hundred fold.

The problems of bath penetration into and fracture of the cermet anodes may be related to solid state diffusion rates. Reducing the bath temperature from 950° C. to 700° C. should reduce the solid state diffusion rates for nickel, iron and copper (contained in Ne—Fe—Cu cermet anodes) by 200–3,000 fold.

As shown in the drawings, rectangular electrodes are employed. The voltage drop through a rectangular electrode is (a) directly proportional to the current density on each side, the resistivity of the electrode material and the square of the height of the electrode, and (b) inversely proportional to the thickness of the electrode. (It is assumed that there is a high conductivity current collector along the top of the electrode (e.g. a copper collector)). The best nickel-iron-copper cermet anode material currently employed in developmental work has a resistivity of 0.0025 Ohm·cm. For a current density of 1 amp/cm$^2$ and electrode height and thickness values of 30 cm and 10 cm respectively, the voltage drop through the anode would be 0.22, an acceptable value. The thickness of the anode can be reduced by employing a core of metal (e.g., Ni) surrounded by the cermet material. In such a case, the core would be 1 cm thick with 0.5 cm of cermet on each side, for a total thickness of 2 cm.

Titanium diboride, the preferred material for the cathode has a resistivity of 10 micro Ohm·cm. For the same current density and electrode dimensions as those described above for the anode, there would be a voltage drop through the cathode of 0.0036. This indicates that, at 10 cm, the cathode is thicker than is required to satisfy the voltage drop requirements. Although reducing the thickness of the cathode would increase the voltage drop through the cathode, nevertheless, the thickness could be reduced substantially from 10 cm without departing from acceptable values for the voltage drop. One may employ a cathode outer layer of 2–3 cm for electrical reasons, together with a sufficient additional cathode thickness for structural strength e.g., a $TiB_2$ outer layer of 2–3 cm on a graphite core.

Present Hall-Heroult cells with horizontal electrodes and a mobile, agitated, molten aluminum cathode are operated at about a 5 cm anode-cathode distance. Solid, vertical electrodes, in accordance with the present invention, can be operated at a closer anode-cathode spacing with a resulting decrease in voltage drop. The distance between the anode and cathode (anode-cathode distance or ACD) in the cell of the present invention permissibly may be 0.5–4.0 cm, preferably 1–2 cm.

The greater the electrode area in a given cell, the greater the production capabilities of the cell. For a Hall-Heroult cell retrofitted with vertical electrodes in accordance with the present invention, the electrode area can be increased substantially. For example, assume the effective area of a Hall-Heroult cathode is the length times the width of the cathode cavity (i.e., the interior of the cell). The effective cathode (and anode) area in a vertical electrode cell having the same length and width dimensions as the Hall-Heroult cell is the Hall-Heroult cathode area times a multiplying factor, H/L, where H is the immersed electrode depth and L is the thickness of a cell (thickness of electrode plus anode-cathode distance). For an electrode having an immersion depth of 30 cm and a thickness of 10 cm with a 2 cm anode-cathode distance, the value of $L=12$ cm. This gives a multiplying factor of 2.5.

As noted above, if one were to retrofit existing Hall-Heroult cells with vertical electrodes in accordance with the present invention, there would be a substantial increase in production. An even greater increase in production would be result from employing these electrodes in a new plant. In such a case, a much larger multiplying factor, H/L, could be obtained, by increasing the electrode height and using thinner electrodes. Doubling the height to 60 cm and decreasing the thickness to 5 cm, with an anode-cathode distance of 1 cm would give a multiplying factor of 10 times that of an equal cavity area in a Hall-Heroult cell. Taller and thinner electrodes, such as those having the dimensions described in the preceding sentence, would require a more conductive anode than the currently used nickel-iron-copper cermets. Such an anode would employ a metal substrate such as nickel, iron or copper, completely surrounded by the cermet.

The two electrode sizes described in the preceding two paragraphs (10 cm×30 cm and 5 cm×60 cm) are examples only. Other electrode sizes, within the limitations of voltage drop and structural strength, may be employed using the features of the present invention.

Because both the anode and cathode are non-consumable, and because both were vertically disposed, there is no need to provide the cell with complicated superstructure and controls for periodically adjusting the anode-cathode distance. Instead, one may employ a relatively simple fixed frame for supporting the electrodes in a stationary position, against movement in either a vertical or horizontal direction. Such a frame is shown diagramatically at 31 in FIG. 3. The frame would be electrically insulated from the anode.

A cell in accordance with the present invention has shorter bus bar (electrical connector) runs between cells, compared to the runs between Hall-Heroult cells. This is because all electrode buses are at the same level, at the top of the cell of the present invention. There is no need for a diagonal bus bar to connect to a cathode at the bottom of the cell, as in a Hall-Heroult cell. Also, there is no need for a ring bus around the cell exterior, as in the Hall-Heroult cell.

In summary, the advantages of an electrolytic reduction cell in accordance with the present invention over a conventional Hall-Heroult cell include: greater electrode area per unit floor area, therefore lower capital costs; a lower operating temperature, therefore higher current efficiency, longer electrode life and longer cell life; non-consumable anodes, therefore lower labor costs, cleaner operation and no carbon costs; and applicability to either a retrofit operation or a new plant. Other advantages of a cell constructed in accordance with the present invention over a conventional Hall-Heroult cell are: no passage of current through the molten metal pad at the bottom of the cell, therefore no troublesome electromagnetic effects; no conduction of current through the lining of the cell, therefore eliminating swelling of the lining; shorter bus bar runs between cells; absence of superstructure and controls for adjusting the anode-cathode distance; and ready replacement of failed cathode and anode plates without shutting down the cell.

The foregoing detailed description has been given for clearness of understanding only, and no unnecessary limitations should be understood therefrom, as modification will be obvious to those skilled in the art.

I claim:

1. A method for reducing alumina to aluminum, employing a vessel having a bottom and sidewalls, said method comprising the steps of:

containing within said vessel a molten electrolyte bath composed of halide salts having a density less than that of molten aluminum and less than that of alumina;

providing within said bath a plurality of vertically disposed, spaced apart, non-consumable anodes and a plurality of vertically disposed, spaced apart, dimensionally stable cathodes in close, alternating relation with said anodes;

maintaining said bath at a temperature substantially below 950° C. (1742° F.);

introducing finely divided, alumina particles into said bath;

forming in said cell a slurry composed of said alumina particles and said bath;

said slurry having a density less than that of molten aluminum;

passing an electric current through said bath from each anode to an adjacent cathode;

forming gaseous oxygen at each anode;

bubbling said gaseous oxygen upwardly from each anode at which said oxygen is formed, through said bath alongside said anode, to agitate the bath sufficiently (a) to enhance the dissolution of alumina in that part of the bath adjacent each anode thereby to obtain substantial saturation of said bath part with dissolved alumina, to maintain the undissolved, finely divided, alumina particles in suspension throughout said agitated bath, and (c) to inhibit substantially said alumina particles from setting out at the bottom of said vessel, thereby to maintain said slurry substantially uniformly throughout the cell;

forming metallic aluminum at each cathode;

flowing said metallic aluminum downwardly along each cathode at which said aluminum is formed, toward the bottom of said vessel;

and accumulating molten aluminum at the bottom of said vessel.

2. A method as recited in claim 1 and comprising:
avoiding metallic aluminum accumulation at the top of said bath.

3. A method as recited in claim 1 wherein:
said finely divided alumina particles are devoid of carbonaceous material;
and said method is performed without the employment of a carbon-containing reducing agent.

4. A method as recited in claim 1 and comprising:
maintaining said bath at a temperature in the range 665°–850° C. (1229°–1562° F.).

5. A method as recited in claim 4 wherein:
said bath has a temperature in the range 690°–750° C. (1274°–1382° F.).

6. A method as recited in claim 1 wherein:
said alumina particles have a size less than 100 microns to help prevent said alumina particles from settling out on the vessel bottom and to help maintain said particles in suspension in said bath.

7. A method as recited in claim 6 wherein:
at least a major portion of said alumina particles, by wt. %, have a size less than 50 microns.

8. A method as recited in claim 1 wherein:
said cell operates at a current density of 0.5–1 A/cm$^2$.

9. A method as recited in claim 1 wherein:
said alumina particles have a concentration in said slurry limited to maintain the specific gravity of said slurry sufficiently below that of molten aluminum (2.3 g/cm$^3$) to allow the molten aluminum to settle to the bottom of said vessel.

10. A method as recited in any of claims 1, 7–8 and 9 and comprising:
maintaining an anode-cathode distance (ACD) between said vertically disposed electrodes in the range 0.5–4.0 cm (0.2–1.6 in.).

11. A method as recited in claim 10 wherein:
said ACD is 1–2 cm (0.4–0.8 in.).

12. A method as recited in claim 1 wherein:
said anodes and said cathodes are each of rectangular shape and are disposed in mutually parallel relation.

13. A method as recited in claim 1 and comprising;
avoiding the passage of current through said molten aluminum at the bottom of said vessel.

14. A method as recited in claim 1 wherein said vessel has a refractory lining and said method comprises:
avoiding the passage of current through said lining.

15. A method as recited in claim 1 wherein:
said bath has a melting point, a viscosity and a solubility therein of alumina under the conditions recited in claim 1, sufficient to permit a cell operating temperature substantially below 950°·C. (1742° F.).

16. A method as recited in claim 1 wherein:
said anodes are composed of a material which will not withstand the conditions to which an anode is subjected in a cell having a cryolite electrolytic bath at a temperature of at least about 950° C. (1742° F.).

17. A method as recited in claim 16 wherein:
said anodes are composed of a cermet which will withstand the service conditions to which an anode is subjected in a cell having the bath characteristics and operating temperature recited in claim 1.

18. A method as recited in claim 1 wherein:
each anode is separated from each cathode by said bath.

19. A combination for use in the electrolytic reduction of alumina to aluminum, said combination comprising:
a vessel having a bottom and walls extending upwardly from said bottom;
a slurry contained within said vessel, said slurry being composed of finely divided alumina particles dispersed in a molten electrolyte bath composed of halide salts having a density less than that of alumina;
said slurry having a density less than that of molten aluminum;
means for maintaining said bath at a temperature substantially below 950° C. (1742° F.);
a plurality of vertically disposed, spaced apart, nonconsumable anodes in said slurry;
a plurality of vertically disposed, spaced apart, dimensionally stable cathodes in said slurry, in close, alternating relation with said anodes;
and means for passing an electric current through said bath from each anode to an adjacent cathode;
each anode comprising means for forming, from said alumina, during passage of said electric current, gaseous oxygen at said anode and for permitting said gaseous oxygen, thus formed, to bubble upwardly through said bath alongside said anode to agitate the bath sufficiently (a) to enhance the dissolution of alumina in that part of the bath adjacent each anode thereby to obtain substantial saturation of said bath part with dissolved alumina, (b) to maintain the undissolved, finely divided, alumina particles in suspension throughout said agitated bath, and (c) to inhibit substantially said alumina particles from settling out at the bottom of said vessel, thereby to maintain said slurry uniformly throughout the cell;
each of said cathodes comprising means for forming metallic aluminum at said cathode, during passage of said electric current;
each cathode having an outer surface wet by molten aluminum and comprising means along which metallic aluminum formed at said cathode flows downwardly toward the bottom of said vessel;
said vessel bottom comprising means for draining and accumulating molten aluminum.

20. A combination as recited in claim 19 and comprising:
means for introducing said finely divided alumina particles into said slurry in said vessel.

21. A combination as recited in claim 19 and comprising:
means fixing said anodes against vertical movement.

22. A combination as recited in claim 19 and comprising:
means fixing said cathodes against vertical movement.

23. A combination as recited in claim 19 wherein:
said anodes and said cathodes are each of substantially planar shape and are disposed in mutually parallel relation.

24. A combination as recited in claim 19 wherein:
said alumina particles have a concentration in said slurry limited to maintain the specific gravity of said slurry sufficiently below that of molten aluminum (2.3 g/cm$^3$) to allow molten aluminum to settle to the bottom of said vessel.

25. A combination as recited in claim 19 wherein:

said alumina particles have a size less than 100 microns to help prevent the alumina particles from settling out on the vessel bottom and to help maintain said particles in suspension in said bath.

26. A combination as recited in claim 25 wherein:

at least a major portion of said alumina particles, by wt. %, have a size less than 50 microns.

27. A combination as recited in any of claims 19, 25 and 26 wherein:

the anode-cathode distance (ACD) between said vertically disposed electrodes is 0.5–4.0 cm (0.2–1.6 in.).

28. A combination as recited in claim 27 wherein:

said ACD is 1–2 cm (0.4–0.8 in.).

29. A combination as recited in claim 19 and comprising:

means electrically insulating said molten aluminum accumulating at the bottom of said vessel from said anodes and said cathodes and for avoiding the passage of electric current through said accumulation of molten aluminum.

30. A combination as recited in claim 19 wherein:

said vessel comprises cooling means for controlling the temperature of said bath contained in the vessel.

31. A combination as recited in claim 19 and comprising:

means for avoiding mixing between the upwardly bubbling gaseous oxygen and the downwardly flowing metallic aluminum.

32. A combination as recited in claim 31 wherein:

each of said cathodes has an exterior surface composed of a material which is wet by said metallic aluminum.

33. A combination as recited in claim 19 wherein:

each of said cathodes has an exterior surface composed of an electrically conductive, refractory hard metal.

34. A combination as recited in claim 13 wherein:

said bath has a melting point, a viscosity and a solubility therein of alumina under the conditions recited in claim 14, sufficient to permit a cell operating temperature substantially below 950° C. (1742° F.).

35. A combination as recited in claim 13 wherein:

said anodes are composed of a material which will not withstand the conditions to which an anode is subjected in a cell having a cryolite electrolytic bath at a temperature of at least about 950° C. (1742° F.).

36. A combination as recited in claim 35 wherein:

said anodes are composed of a cermet which will withstand the service conditions to which an anode is subjected in a cell having the bath characteristics and operating temperature recited in claim 14.

37. A combination as recited in claim 19 wherein:

each anode is separated from each cathode by said bath.

* * * * *